US006149567A

United States Patent [19]

Capy et al.

[11] Patent Number: 6,149,567

[45] Date of Patent: Nov. 21, 2000

[54] METHOD FOR MANUFACTURING A PAPER-BASED CONTAINER, DEVICES FOR ITS IMPLEMENTATION AND CONTAINERS OBTAINED

[76] Inventors: Gilbert Capy, La Botte, F-69640 Jarnioux, France; Akiva Buchberg, 5030 Pine Tree Dr., Miami-Beach, Fla. 33140

[21] Appl. No.: 09/219,869

[22] Filed: Dec. 24, 1998

[51] Int. Cl.[7] ..... B31B 1/90

[52] U.S. Cl. ..... 493/219; 493/198; 493/210

[58] Field of Search ..... 493/219, 220, 493/191, 231, 198, 210, 223, 264, 374, 379; 383/119

[56] References Cited

U.S. PATENT DOCUMENTS

| | | | |
|---|---|---|---|
| 4,581,007 | 4/1986 | Kamp | 493/264 |
| 4,610,029 | 9/1986 | Huhtala et al. | 493/210 |
| 4,889,523 | 12/1989 | Sengewald | 493/198 |
| 5,026,173 | 6/1991 | Jensen | 493/210 |
| 5,049,118 | 9/1991 | McNabb | 493/210 |
| 5,254,073 | 10/1993 | Richison et al. | 493/195 |
| 5,547,284 | 8/1996 | Imer | 383/104 |
| 5,951,452 | 9/1999 | Stevenson | 493/210 |

FOREIGN PATENT DOCUMENTS

| | | |
|---|---|---|
| 9300042 | 8/1994 | Netherlands . |
| 859160 | 1/1961 | United Kingdom . |

*Primary Examiner*—Eugene Kim
*Attorney, Agent, or Firm*—Greenblum & Bernstein, P.L.C.

[57] ABSTRACT

Manufacturing method to make simultaneously two paper containers having a front surface and a rear surface, opposed at their support base by three superimposed strips of paper, the intermediate strip being shaped like a sheath sandwiched between the other two strips on which longitudinal folds are formed which, after the containers are separated, serve as a reinforcement of their support base. The invention also includes the device for implementing the method, as well as the containers thus obtained.

21 Claims, 6 Drawing Sheets

METHOD FOR MANUFACTURING A PAPER-BASED CONTAINER, DEVICES FOR ITS IMPLEMENTATION AND CONTAINERS OBTAINED

BACKGROUND OF THE INVENTION

1. Field of the Invention

The present invention relates to a method for manufacturing a paper-based container, the devices for its implementation and the containers thus obtained.

2. Description of Background and Material Information

Containers generally designed for containing liquids are known, FIGS. 1 and 2 illustrating an example having a rectangular front surface 1 and a rectangular rear surface 2, having the same width and height, and a bottom 3 formed from a rectangular sheet having the same width and a substantially lower height than the front 1 and rear 2 surfaces, and folded in half along its width to form a bellows. The complex film constituting the front 1 and rear 2 surfaces has, on the outside, a film made of a plastic material that is rendered semi-rigid by using it in a more substantial thickness than strictly required and, on the inside, a glued film that is adapted for welding at a substantially lower temperature than the fusion temperature of the outside film. On the contrary, the complex film composing the bellows is very flexible but has a similar structure with an outside film supporting a glued film for welding. The front 1 and rear 2 surfaces are bound together by the welding of their lateral parts 4 either directly at their upper portion, or indirectly at their lower portion via the bottom 3 forming the bellows. The edges 14 of the bellows forming the bottom 3 laterally have, in the width of the lateral welds 4, cutouts 5 (FIG. 5) that correspond to one another such that the front 1 and rear 2 surfaces come into contact directly at the level of the bottom 3 and are welded together so as to laterally block the opening of the bellows formed by the bottom 3. Each side of the bellows of the bottom 3 is furthermore bound to the front 1 and rear 2 surfaces facing it respectively, in the middle part located between the lateral parts 4 on the surface of a binding zone 13 extending from the support base 6 to a "U"-shaped curve 7 that starts at the upper fold 8 of the bottom 3 forming the bellows, at the level of the left lateral part 4, to end back at the upper fold 8 of the bottom 3 forming the bellows, but at the level of the right lateral part 4, the middle part 9 of the curve 7 being a few millimeters away from the support base 6. When such a small bag is unfolded, the front 1 and rear 2 surfaces (FIG. 2) are spaced from each other by bending in the shape of a half cylinder having vertical generatrices and a cross-section predetermined by the previously described "U"-shaped curve 7 limiting the binding zone 13 of the bottom 3 forming the bellows which is bound to the front 1 and rear 2 surfaces. The bottom 3 forming the bellows is unfolded until its free part 10 is stretched, which provides a maximum spacing in the middle part 9 of the curve 7 which is also the middle part of the front 1 and rear 2 surfaces. In this zone, the free part 10 of the bottom 3 is near the support base 6, and the spacing of the front 1 and rear 2 surfaces is gradually reduced as it nears the edges, and the free part 10 of the bottom 3 progressively rises to the level of the fold 12 of the bottom 3 where the front 1 and rear 2 surfaces come together to be welded. The support base 6 is formed by the base of the front 1 and rear 2 surfaces, welded to the walls of the bottom 3 forming the bellows, which provides a sufficient rigidity so that the container stands upright. This container is generally filled, especially with a liquid, and the front 1 and rear 2 surfaces are welded together at their top so as to seal the container. The welding of this container's inside film is achieved by a high frequency radiation to which the outside film is not susceptible.

SUMMARY OF THE INVENTION

An object of the invention is a method for manufacturing a container of the aforementioned type but in which the outside film is replaced with paper bound through gluing paper onto paper by coating only the areas of the previously described lateral parts 4 and binding zone 13 with glue. In another version, the container can have a plastic film on the inside, such as polyethylene, which allows welding as described previously by means of thermal electrodes that weld through paper. As for the binding of the edges 14 of the bellows to the lateral edges of the front 1 and rear 2 surfaces, it can be done through cutouts 5 (FIG. 5), as described previously, but also by gluing paper onto paper along a rectangular zone 41 which allows binding the bellows laterally. Given that paper has the ability of binding itself to molten polyethylene, the paper constituting the bottom 3 forming the bellows could be without an internal polyethylene film and be bound nonetheless to the front 1 and rear 2 surfaces which are coated with a polyethylene film. In a preferred version of the invention, and by way of non-limiting example, the container serves for packaging a quantity of French fries, of about 100 grams to 150 grams. The rear surface 2 (FIG. 2) is higher than the front surface 1, by 10 millimeters to 25 millimeters, to facilitate the manual opening of the container. The bellows of the bottom 3 (FIG. 1) has a depth 21, of 25 millimeters to 50 millimeters, which increases with the width of the container. The paper covering the outside of the front 1 and rear 2 surfaces has preferably the same thickness, between 35 grams and 50 grams per square meter, whereas the paper constituting the bottom 3 forming the bellows has a smaller thickness, preferably of about 20 grains to 30 grains per square meter. When the papers are coated with polyethylene on their internal surface, the coating is done at the rate of 6 grains to 10 grains per square meter.

BRIEF DESCRIPTION OF DRAWINGS

The invention will be more clearly understood and other characteristics thereof will become apparent with reference to the following description and the annexed drawings, in which.

DETAILED DESCRIPTION OF THE INVENTION

Figure 1:
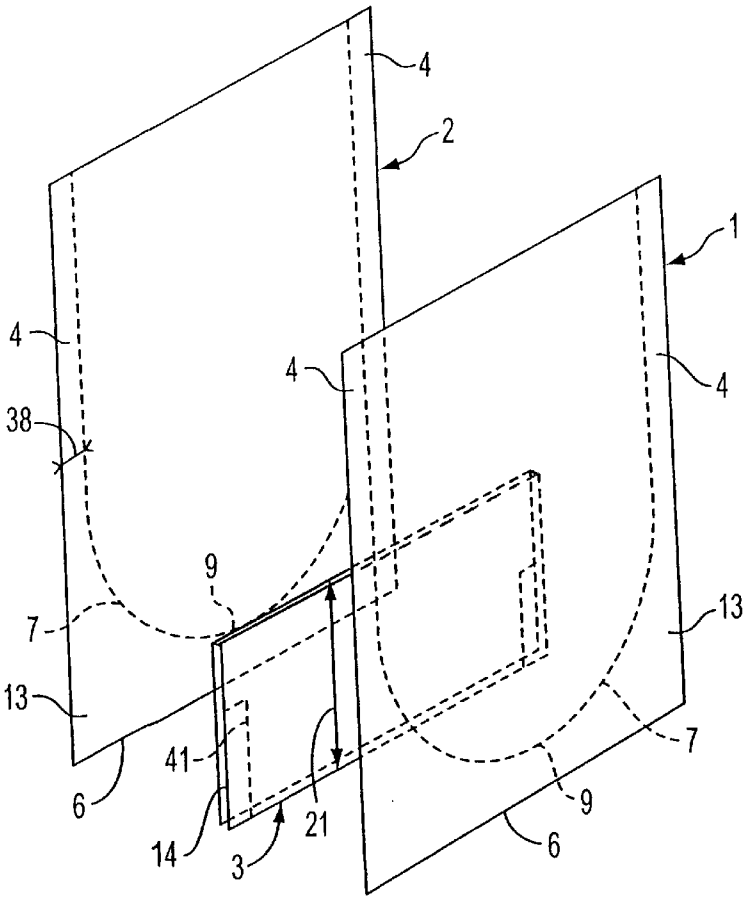

A first device according to the invention allows manufacturing two containers 15 and 16 simultaneously, connected together at their base and which are then separated by cutting; these containers 15 and 16 which have the same width can have different heights. Hereinafter, the simplest of cases is described. which consists of simultaneously manufacturing two identical containers 15 and 16 with papers coated, over the whole area of one of their surfaces, with a polyolefin-based plastic material or equivalent product for welding. One starts with three coils, the first of which delivers a lower strip 17 (FIG. 3) of coated paper with a width 18 corresponding to the sum of the heights of the rear surface 2 (FIG. 1) of the containers 15 and 16, and is positioned so as to unwind the lower strip 17 of paper in a horizontal direction, for example, with the coated surface facing upward. The second coil delivers an intermediate strip 19 (FIG. 3) with a width 20 substantially equal to four times the depth 21 (FIG. 1) of the bellows, and is positioned to unwind the intermediate strip 19 horizontally with the coating facing downward and which, after being shaped, as will be described hereinafter, will position itself, with its axial plane of symmetry located in the axial plane of symmetry of the lower strip 18, above and in contact with the latter. The third coil delivers an upper strip 22 with a width 23 equal to the sum of the heights of the front surface 1 (FIG. 1) of the containers 15 and 16, and is positioned so as to be capable of unwinding the upper strip 22 above the other two strips with its axial plane of symmetry merged with that of the other two. As for the intermediate strip 19, a coating is made in the form of a rectangle of glue 24, for example, used for binding the edges 14 of the bellows to the surface of paper located on top in the example chosen, at regular intervals and corresponding to the width 25 of a container, on a rectangular surface arranged coaxially with the intermediate strip 19 over a width perpendicular to the axis of the intermediate strip 19, of about 2 to 4 centimeters, and over a length preferably less than or equal to twice the width 28 of the lateral parts 4 (FIG. 1). A sheath is formed to have a shape of a sailor's collar, for example, by bringing the lateral edges 26 (FIG. 3) of the intermediate strip 19 to touch one another above the middle part of the latter and in the axial plane of symmetry so that the plastic film is on the outside of the sheath. Next, the sheath is crushed so that the lateral edges 26 are in the axis 27 of the intermediate strip 19 and are bound step by step to the rectangles of glue 24 previously laid on the middle part of the intermediate strip and which are on the inside of the sheath. The same result can be obtained by turning each of the two lateral edges 26 with guides appropriately spaced so as to form a longitudinal fold on each side with a depth corresponding to the depth of the bellows such that the lateral edges 26 come together on the axis 27, as described previously. The intermediate strip 19 thus shaped is laid on the lower strip 17, and then it is covered by the upper strip 22.

In an alternative embodiment of the invention, the lateral edges 26 that close the tube along the axis 27 can overlap each other by 1 to 2 centimeters, which simplifies the adjustments and, as will be seen later, reinforces the vertical resistance of the container. Preferably, the axial part of the overlapping zone is substantially in the axial plane of symmetry of the lower 17, intermediate 19 and upper 22 strips; in this case, the overlapping parts are preferably bound over their whole length. When an intermediate strip 19 of paper coated with a heat-sealing plastic film is used, no special precautions need to be taken; however, if the intermediate strip is not coated, it is preferred to put a coating of glue on the upper part of the lateral strip 26 of the intermediate strip which will cover the other lateral strip 26 at the same time that the previously described rectangles of glue 24 are laid.

Figure 3:
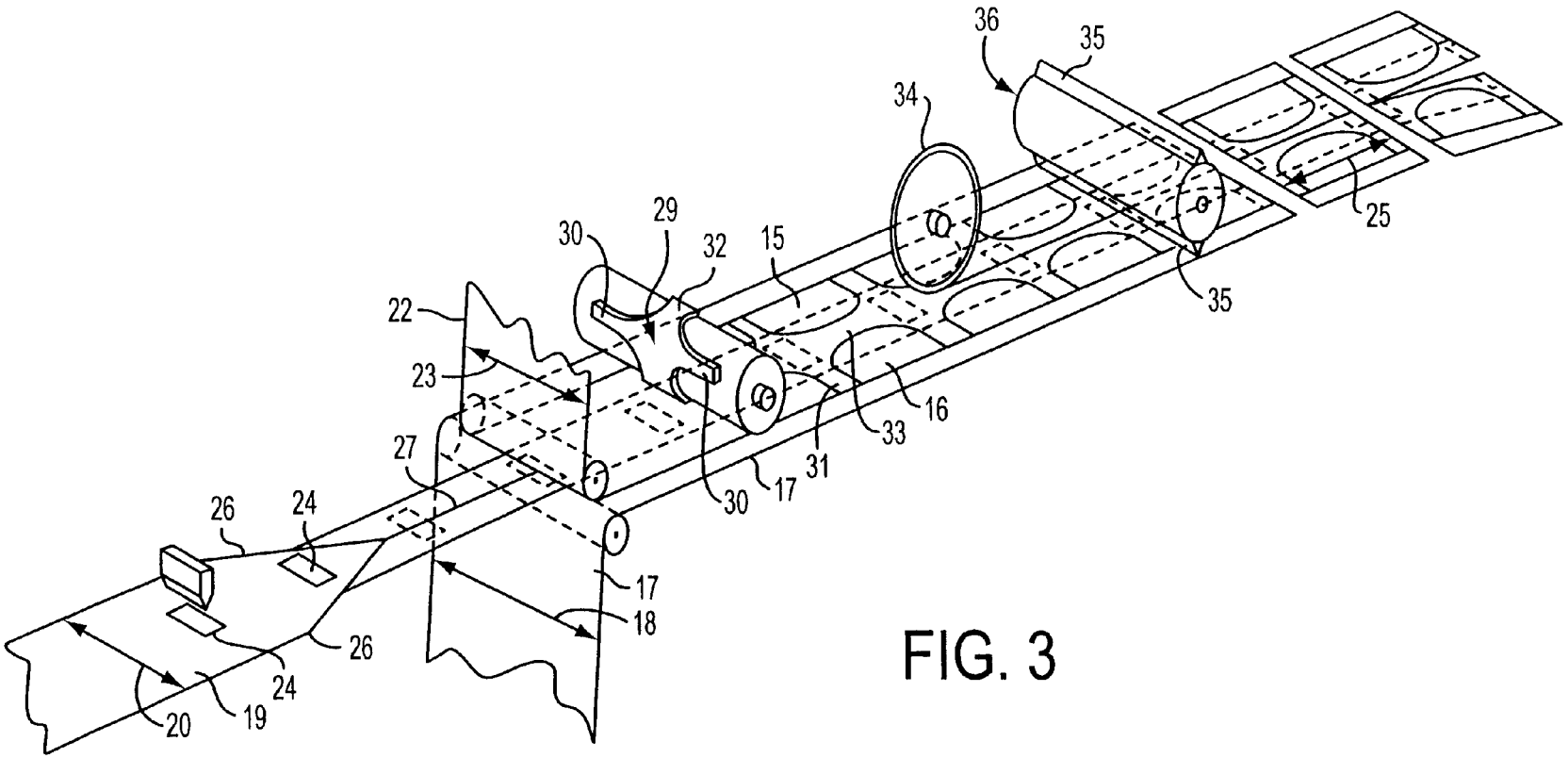
FIG. 3 schematically shows a device according to the invention producing two containers simultaneously and using paper plastic-coated on one surface.

The assembly of the three superimposed strips then passes between a hot electrode and a counter electrode (not shown in FIG. 3), or two hot electrodes (only one of which is shown in FIG. 3) which are cylinders rotating around electrically heated horizontal axles. The heating cylinder(s) present the zone 29 to be welded, in the form of an "H", successively laid over a distance corresponding to the width 25 of the container, the vertical arms 30 of the "H" making the lateral welds 31 of two consecutive containers. The horizontal part 32 of the "H" allows making the bottoms simultaneously in welding zones 33 of the two containers placed opposite each other at their bottom. The rectangle of glue 24 must be laid on the intermediate strip so that, during welding by the heating cylinder(s), it is placed at the level of the vertical arms 30 of the "H" corresponding to the lateral welds 31.

What remains is cutting in the axial plane of the three welded strips in order to separate the bottoms of the opposing containers, for example, by means of a cutting disk 34 whose main plane is in the axis of the strips, then making a transverse cut to separate the successive containers connected by their lateral welds 31 with at least one cutting bar 35 perpendicular to the axis of the strips attached to a rotating cylinder 36.

Figure 4:
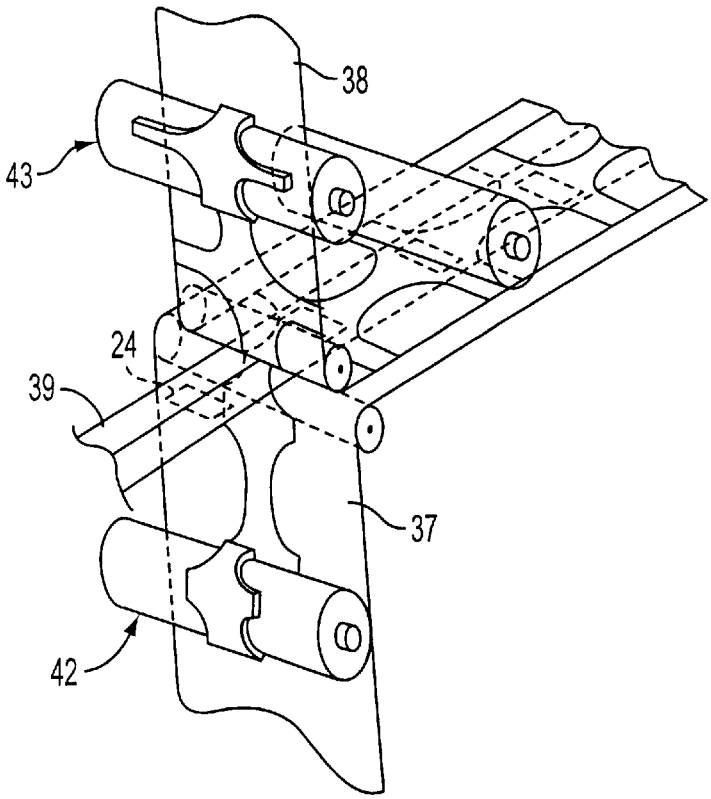
FIG. 4 schematically shows a device using papers bound together by glue.
Figure 5:
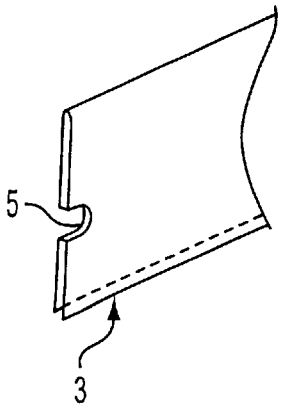
FIG. 5 shows the detail of a lateral binding means of the bottom forming the bellows.

In an alternative embodiment of the invention, when the paper used is not coated with plastic over its whole surface, the upper part of the lower strip 37 (FIG. 4) is coated with glue as is the lower part of the upper strip 38, before they are assembled to the shaped intermediate strip 39, on a surface identical to the previously described welding surface, due to gluing cylinders 42 and 43. The three strips are pressed between two cylinders 40 (only one of which is represented in FIG. 4), heated or non-heated, depending upon whether the glue is hot or cold. As was previously specified, when the intermediate strip 39 has an overlapping zone for the lateral edges after being shaped, the lateral edges that overlap each other are preferably bound together. One can proceed with the longitudinal and transverse cuttings, as described previously.

Figure 2:
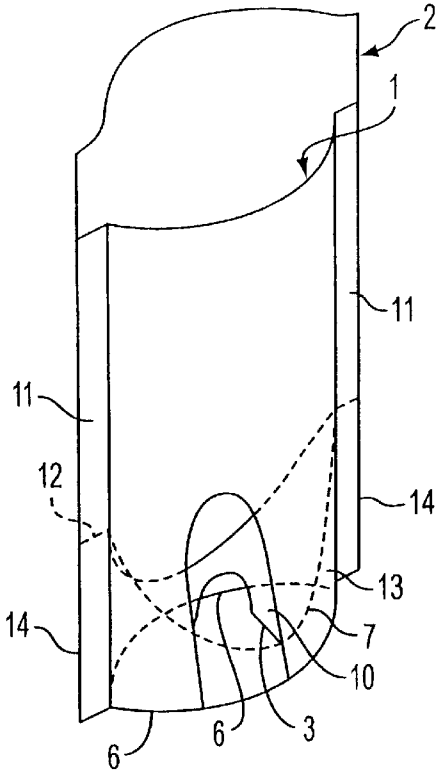
FIGS. 1 and 2 illustrate an example of the known prior art container described above.

In the case where there is an overlapping of the lateral parts of the intermediate strip during its shaping, this overlapping is found in the form of a third thickness of paper at the base 6 (FIG. 2) of the front surface 1, which significantly increases the container's rigidity.

An improvement to the container made by means of the device that has just been described consists of reinforcing the container base without increasing the thickness of the front and rear surfaces.

To this end, the container is made from three strips of paper (FIG. 6) which are coated either with a heat-sealing material over their whole surface, or with glue at the level of the zones that must be glued together. There is a lower strip 44 to make the rear surface 2 (FIG. 7) of the container, an upper strip 45 (FIG. 6) to make the front surface 1 (FIG. 7) of the container, and between then an intermediate strip 46 (FIG. 6) folded to form a sheath and make the container's bellows. After assembly of the strips 44, 45, 46, in order to manufacture containers opposing each other at their support base 6 (FIG. 7) two by two, the containers are separated at the level of their support base 6 by an axial cutting of the assembled strips 44, 45, 46, and at the lateral level by a transverse cutting of the strips. Hereinafter, it is supposed that the two containers connected at their base are identical, but they can also have different heights.

A device for manufacturing this container allows making, on each of the lower 44 and upper 45 strips, two longitudinal folds 47 and 48 (FIG. 8), laid opposite one another symmetrically, on both sides of the axial line 49 and 50 (FIG. 6) of the lower 44 and upper 45 strips, so as to form a dovetail outline with two folds 51 and 52 facing each other and two folds 53 and 54 opposing each other. These folds 47 and 48 are preferably made with the dovetail turned inwardly so as not to be visible from the outside of the container, and these folds 47 and 48 have a width 55 and 56 preferably identical and preferably substantially equal to the distance 57 (FIG. 7) separating the support base 6 from the lower part 58 of the bottom of the container when it is unfolded; the edges of the folds 51 and 52 (FIG. 8) facing each other are separated by 1 to 2 millimeters.

Figure 6:
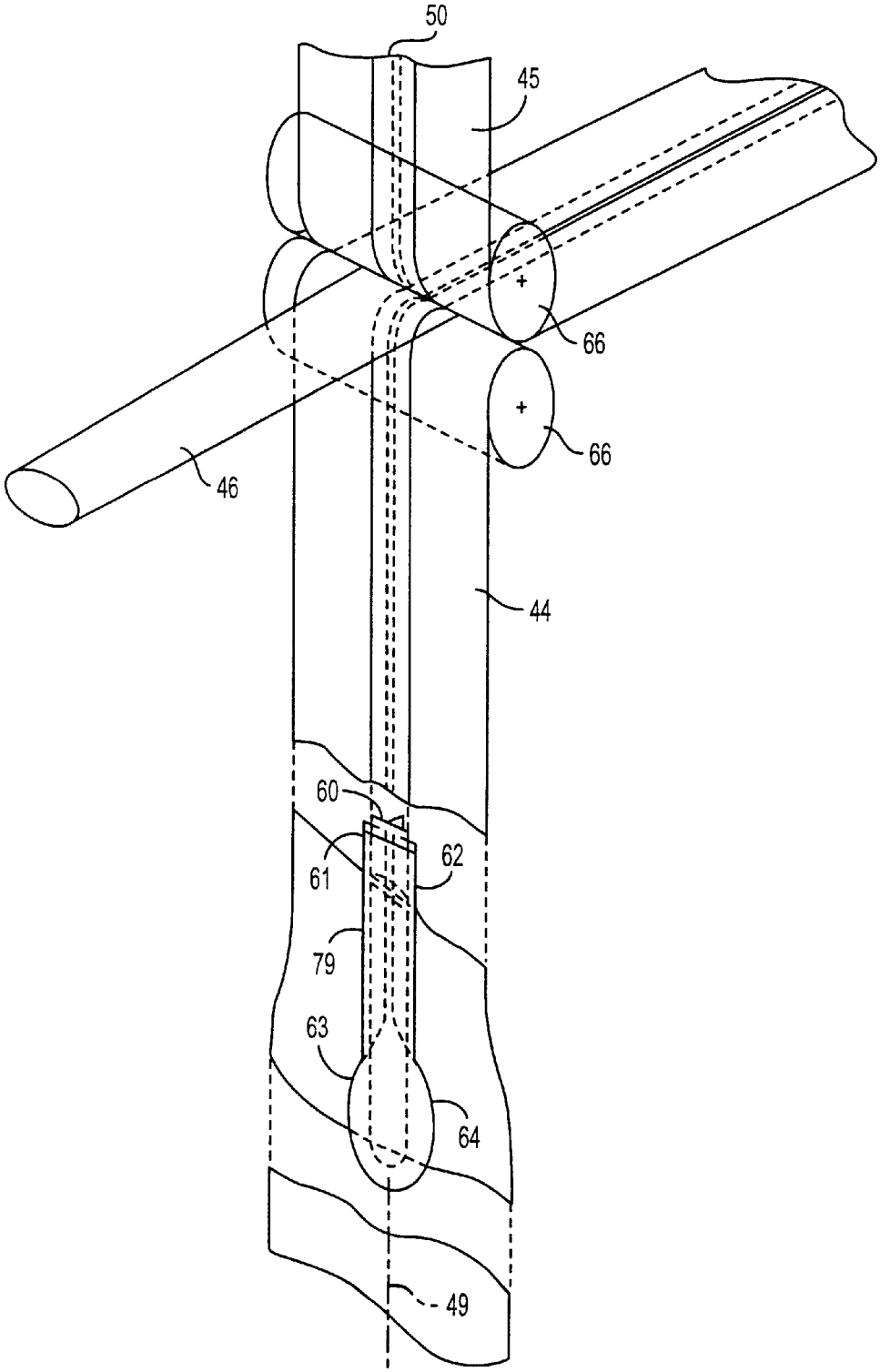
FIG. 6 shows, schematically and in a partial perspective, a device that allows obtaining the folding of a container to reinforce its support base.
Figure 7:
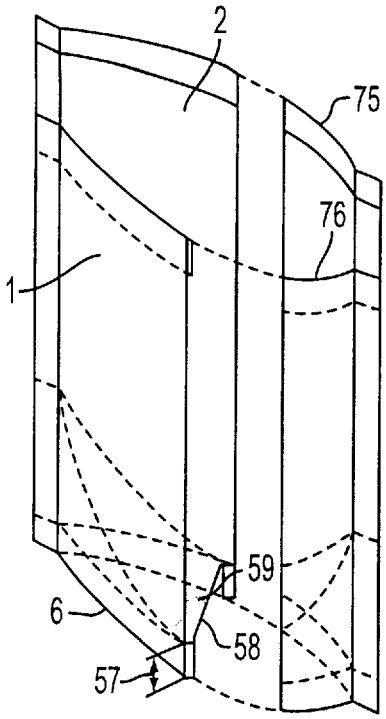
FIG. 7 shows a container whose support base is reinforced by means of the folding obtained with the device shown in FIG. 6.
Figure 8:
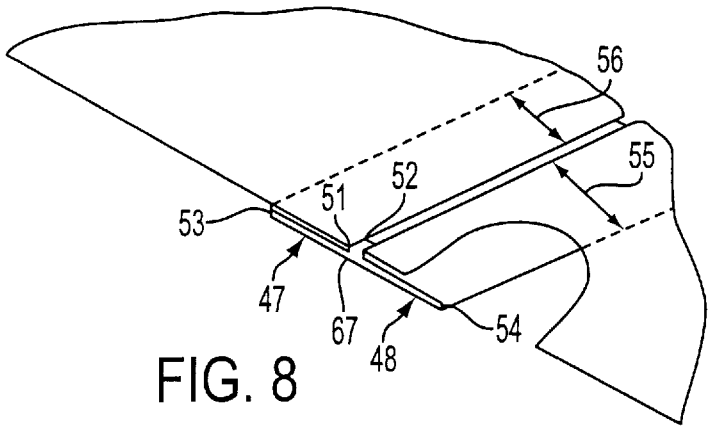
FIG. 8 shows, in a cross-section and in perspective, the reinforcement folding of the support base of the container.
Figure 9:
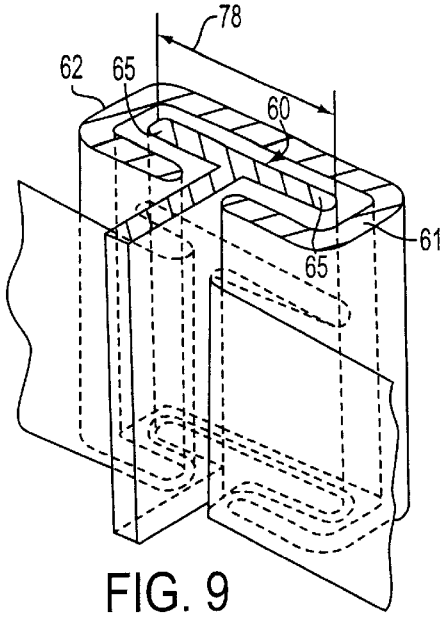
FIG. 9 shows in perspective and in a transverse cross-section the folding device.
Figure 10:
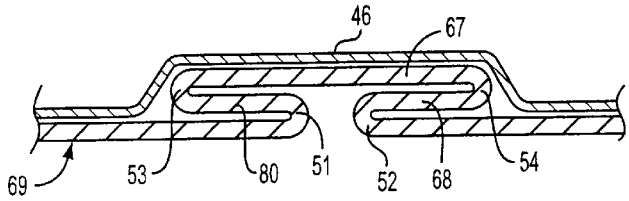
FIG. 10 shows a cross-section of the folding obtained in FIG. 8 and assembled to the sheath serving as the bellows for the container.
Figure 11:
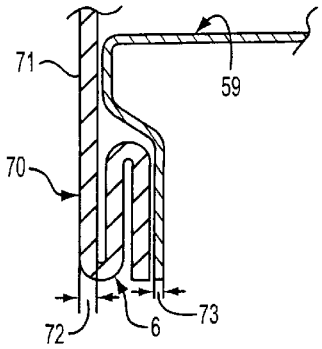
FIG. 11 shows a partial cross-section of the reinforced support base of the container.

There are numerous means for making this longitudinal dovetail shaped fold according to FIG. 8; one means for making it is to use a folding device 79 (FIG. 6) constituted of slides, this example being non-limiting. This folding device 79 is constituted of a middle slide 60 (FIGS. 6 and 9), having a width 78 corresponding substantially to the width of the strip portion 67 (FIG. 8) located between the opposing folds 53 and 54, and placed on the lower 44 and upper 45 strips (FIG. 6). On the outside of the future container, oriented coaxially to the corresponding strip. The folding device 79 is then constituted of two lateral slides 61 and 62 (FIG. 9), placed on the inside of the corresponding strip 44 or 45 (FIG. 6) on both sides of the middle slide 60, having a form that varies depending on tile distance considered from the origin 63 or 64 of the lateral slide 61 or 62 considered. They progressively take on a "C" shape so as to draw the middle part of the strip to cap the wings 65 (FIG. 9) of the middle slide 60. What remains, for example, is to pass the lower 44 and upper 45 strips (FIG. 6) between two pressure cylinders 66 to mark the folds. The strip portion 67 (FIGS. 8 and 10) joining the two opposing folds 53 and 54 is bound to the sheath constituted of the intermediate strip 46. The strip portions 80 and 68, located on both sides of the axis of the related lower or upper strip 69 (FIG. 10), are pressed against the latter at least by their edges; on the one hand, by their facing folds 51 and 52 (FIG. 10) and, on the other hand, by the intermediate strip 46 serving to form the bellows, which is also directly bound to the corresponding lower or upper strip 69 beyond the opposing folds 53 and 54. It is possible, according to certain dimensions, that the opposing folds 53 and 54 open out inside the lower part 58 (FIG. 7) of the bottom 59 of the container and therefore are not held by the binding on the intermediate strip 46 which is no longer bound in this zone to the related lower or upper strip 69 (FIG. 10); but that is a small proportion of the length of the support base 6 (FIG. 7) which is not bound and is of no consequence, especially as when lower or upper strips 69 (FIG. 10) coated over their whole surface with a heat-sealing material are used for manufacturing the container, each strip portion 80 and 68 is heat-sealed over part or its entire surface to the corresponding lower or upper strip 69. In these conditions, after the longitudinal and transverse cutting of the strips assembled together, containers are obtained whose zone near to the support base 6 (FIG. 11) of the front and rear surfaces has a reinforcing device 70 with three times the thickness 72 of the paper forming the surfaces 71 of the container, and at least one time the thickness 73 of the paper forming the bellows. This gives a weight by the square meter in this zone 70 of between 135 grams and 180 grams per square meter for one surface, and 165 grams and 210 grams per square meter for the other surface. In these conditions, a support base 6 is obtained that no longer bends under the weight of the container's load.

In an alternative embodiment of the invention, the lateral edges (FIG. 6) of the upper 45 and lower 44 strips are folded over a width of 5 millimeters to 10 millimeters on the inside, and they are bound by welding or gluing in order to dull the upper edges 75 and 76 (FIG. 7) of the container. The lateral edges can be folded due to a folding device composed of slides similar to those previously described and which are commonly used.

What is claimed is:

1. A method for manufacturing at least two containers simultaneously, each container including a first side portion, a second side portion, and a bottom folded portion, the method comprising:

applying a substantially rectangular coating of glue to an intermediate strip at substantially regularly spaced intervals, the intermediate strip having a first edge and a second edge;

folding the intermediate strip so that each of the first edge and the second edge covers some portion of the rectangular coating;

feeding each of a lower strip and an upper strip along a first direction;

feeding the folded intermediate strip in the first direction so that the intermediate strip is disposed between the lower strip and the upper strip;

assembling the upper strip, the intermediate strip, and the lower strip to make a layered structure; and separating the at least two containers from the layered structure, wherein the first side portion of each container comprises some portion of the upper strip, the second side portion of each container comprises some portion of the lower strip, and the bottom folded portion of each container comprises some portion of the intermediate strip.

2. The method of claim 1, wherein one of the lower strip, the intermediate strip, and upper strip comprises a paper-based sheet.

3. The method of claim 1, wherein the separating further comprises cutting through each of the upper strip, the intermediate strip, and the lower strip of the layered structure so as to make the at least to containers.

4. The method of claim 3, wherein the cutting comprises cutting through the rectangular coating.

5. The method of claim 1, wherein the assembling further comprises joining some portion of the upper strip to some portion of the lower strip.

6. The method of claim 5, wherein the separating further comprises cutting through the joined portions to form a lateral edge of a container.

7. The method of claim 1, wherein the assembling further comprises joining some portion of each of the upper strip and the lower strip to some portion of the intermediate strip.

8. The method of claim 7, wherein the joining comprises one of welding and glueing.

9. The method of claim 7, wherein the separating further comprises cutting through the joined portions to form at least one lateral edge of a container.

10. A container made by the method claim 1, wherein each of the first side portion and the second side portion comprises lateral edges, the lateral edges of the first side portion being to joined to the lateral edges of the second side portion, and wherein the folded bottom portion comprises lateral edges which are disposed, in a bottom region of the container, between the lateral edges of the first side portion and the second side portion.

11. An apparatus for manufacturing at least two containers simultaneously, each container including a first side portion, a second side portion, and a bottom folded portion, the apparatus comprising:

a device for applying a substantially rectangular coating of glue to an intermediate strip at substantially regularly spaced intervals, the intermediate strip having a first edge and a second edge;

a device for folding the intermediate strip so that each of the first edge and the second edge covers some portion of the rectangular coating;

a device for feeding each of a lower strip and an tipper strip along a first direction;

a device for feeding the folded intermediate strip in the first direction so that the intermediate strip is disposed between the lower strip and the upper strip;

a device for assembling the upper strip, the intermediate strip, and the lower strip to make a layered structure; and a device for separating the at least two containers from the layered structure, wherein the first side portion of each container comprises some portion of the upper strip, the second side portion of each container comprises some portion of the lower strip, and the bottom folded portion of each container comprises some portion of the intermediate strip.

12. The apparatus of claim 11, wherein the device for assembling comprises one of;

a hot electrode and one counter electrode, and two hot electrodes.

13. The apparatus of claim 11, wherein at least one hot electrode comprises an electrically heated rotating cylinder having a raised zone for welded.

14. The apparatus of claim 13, wherein the raised zone comprises a shape which substantially corresponds to an "H", the raised zone being adapted to weld lateral edges of the at least two containers simultaneously.

15. The apparatus of claim 11, further comprising at least one device for applying glue to one of the lower strip and the lower strip.

16. The apparatus of claim 15, wherein the at least one device for applying glue to the lower or upper strips comprises at least one gluing cylinder which applies glue to one of the lower strip and the upper strip.

17. The apparatus of claim 16, further comprising two gluing cylinders, one gluing cylinder applying glue to the lower strip and another gluing cylinder applying glue to the upper strip.

18. The apparatus of claim 17, wherein at least one gluing cylinder operates in one of a heating mode and non-heating mode depending on whether the glue can be applied hot or cold.

19. The apparatus of claim 11, wherein the device for separating comprises a rotating cylinder having at least one cutting bar.

20. The apparatus of claim 11, further comprising a device for severing the layered cylinder having at least one cutting bar.

21. The apparatus of claim 20, wherein the device for separating comprises a rotating cylinder having at least one cutting bar.

* * * * *